US005105505A

United States Patent [19]

Reed, Jr.

[11] Patent Number: 5,105,505

[45] Date of Patent: Apr. 21, 1992

[54] HAND-HELD VACUUM CLEANER

[75] Inventor: Charles A. Reed, Jr., Shelton, Conn.

[73] Assignee: Black & Decker Inc., Newark, Del.

[21] Appl. No.: 637,412

[22] Filed: Jan. 4, 1991

[51] Int. Cl.[5] ..... A47L 5/26

[52] U.S. Cl. ..... 15/344; 15/347; 15/350

[58] Field of Search ..... 15/344, 347, 350, 351; 55/368

[56] References Cited

U.S. PATENT DOCUMENTS

| | | | |
|---|---|---|---|
| 1,792,975 | 2/1931 | Gilbert | 15/344 |
| 1,907,335 | 5/1933 | Riebel | 55/374 |
| 2,016,294 | 10/1935 | Replogle | 55/368 |
| 2,098,632 | 11/1937 | Parks | 55/368 |
| 4,741,070 | 5/1988 | Sovis et al. | 15/344 |
| 4,800,614 | 1/1989 | Kopco et al. | 55/378 X |

FOREIGN PATENT DOCUMENTS

| | | | |
|---|---|---|---|
| 694801 | 8/1940 | Fed. Rep. of Germany | 55/368 |

*Primary Examiner*—Chris K. Moore

*Attorney, Agent, or Firm*—Barry E. Deutsch

[57] ABSTRACT

A hand-held vacuum cleaner includes a housing having first and second half housing elements. The housing has a handle and a nozzle. A motor is mounted within the housing for driving a shaft. A fan is mounted on the shaft for rotation therewith. A selectively separable bag assembly is mounted on the housing. A working air channel is formed within the housing for communicating the nozzle with the bag assembly. The air channel terminates in a working air outlet chute positioned within the bag assembly at its open upper end. The shaft is positioned within the housing generally normal to the direction of air flow within the working air channel.

4 Claims, 1 Drawing Sheet

HAND-HELD VACUUM CLEANER

BACKGROUND OF THE INVENTION

This invention relates to hand-held vacuum cleaners and in particular to hand-held vacuum cleaners having improved air-flow resulting in improved performance.

AC powered hand-held vacuum cleaners have become increasingly popular in the past several years. Such cleaners are particularly useful where conventional larger size vacuum cleaners such as large canister or upright types are inconvenient for the user. Such hand-held vacuum cleaners are particularly useful in cleaning stairs and furniture. Examples of these AC powered hand-held vacuum cleaners are found in U.S. Pat. Nos. 4,700,428 and 4,891,861.

Due to their reduced size, such hand-held vacuum cleaners, do not have the same suction power as do the larger conventional cleaners To minimize the loss of suction power, the working air path through the cleaner should be designed to provide an unobstructed, generally continuous air flow channel from the inlet nozzle to the collector bag for receiving the dirty air. Heretofore, the conventional hand-held vacuum cleaners of the type described, as exemplified by the unit illustrated in U.S. Pat. No. 4,891,861, have wasted suction power by causing the working air to flow through a rather circuitous air path within the cleaner. The loss of suction power has reduced the operating efficiency of the unit.

In U.S. Pat. No. 2,184,446 there is illustrated a vacuum cleaner having a motor mounted in a vertical orientation However, the illustrated cleaner is not a hand-held type, but is rather a large upright cleaner.

Accordingly, it is an object of this invention to provide a hand-held vacuum cleaner having an air-flow channel which directs the air in a generally straight flow path from the inlet nozzle to the dirt collector bag.

SUMMARY OF THE INVENTION

The foregoing object and other objects of the invention are attained in a hand-held vacuum cleaner including a housing comprising mating first and second half housing elements The housing has a handle and a nozzle. A motor is mounted within the housing for driving a shaft. A fan is mounted on the shaft for rotation therewith A selectively separable bag assembly is mounted on said housing. Means defining a working air channel within the housing communicates the nozzle with the bag assembly. The air channel terminates in a working air outlet chute positioned within the bag assembly at its open upper end.

Further, the shaft is positioned within the housing generally normal to the direction of air flow within the working air channel. The air drawn into the housing flows through the nozzle axially towards the bag assembly and thence upwardly through the fan and again axially into the bag assembly.

DESCRIPTION OF THE PREFERRED EMBODIMENT

Figures 1, 2:
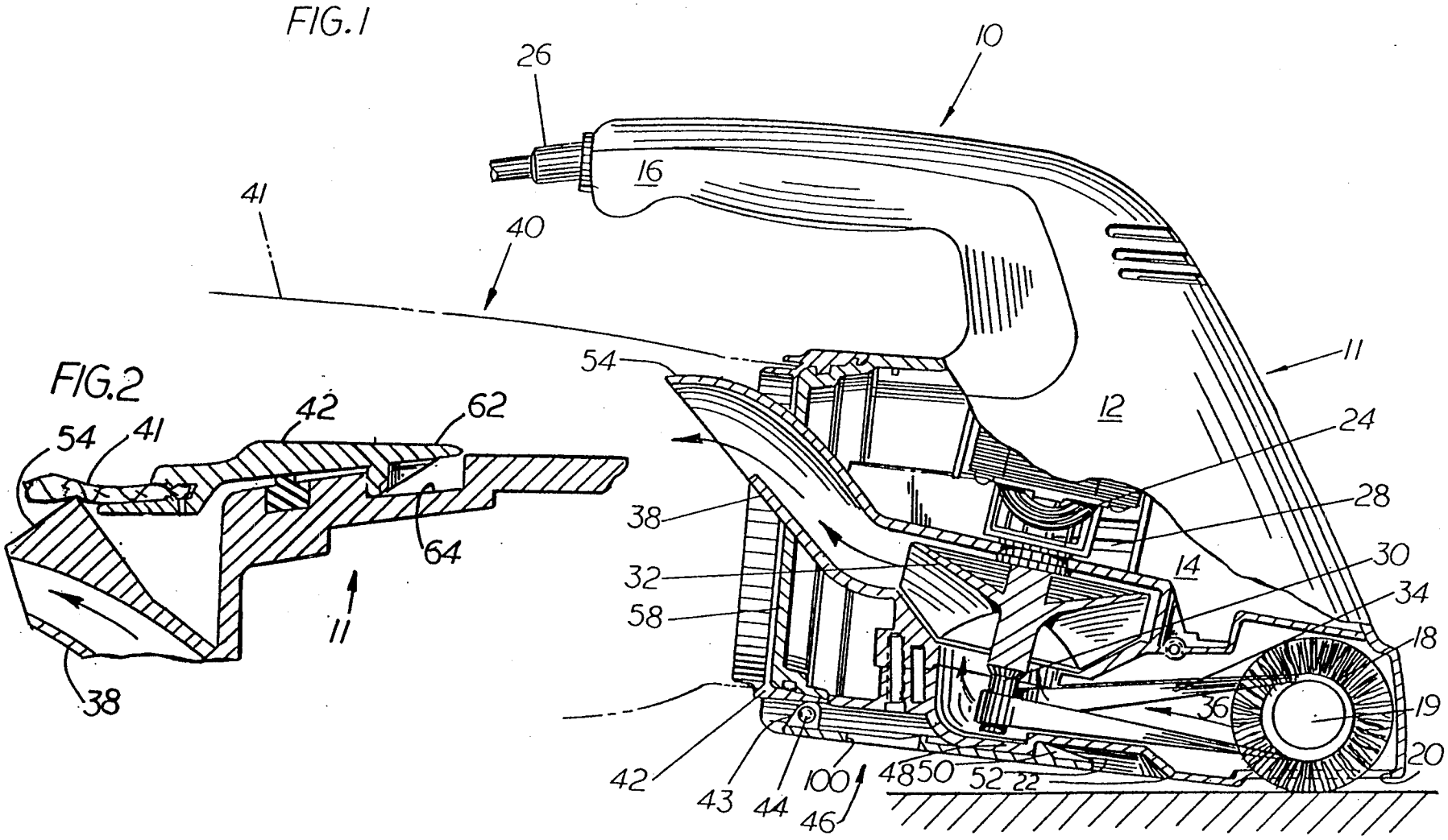
FIG. 1 of the drawing is a side view, partially in cross section, of a hand-held vacuum cleaner embodying the present invention.
FIG. 2 of the drawing is a fragmentary sectional view of a detail of the cleaner illustrated in FIG. 1.

Referring now to the drawing, there is disclosed a hand-held vacuum cleaner generally designated by the reference numeral 10. Vacuum cleaner 10 comprises a housing generally designated by reference numeral 11. The housing has two mating half elements 12, 14 which are joined together via a tongue and groove joint. A handle 16 extends outwardly from the top of housing 11.

Housing 11 includes a member 22 defining the lower wall of cleaner 10. Member 22 is removably connected to first and second half housing elements 12, 14. Member 22 has an opening 20 defining the intake nozzle for vacuum cleaner 10. A rotating brush 18 is mounted within the nozzle. Brush 18 includes a spindle 19 which is mounted in opposed bearing housing cavities (not shown) mounted in the side wall of member 22. An endless belt 34 is wrapped around spindle 19 for rotationally driving brush 18.

A motor 24 is supported between the two half housing elements 12, 14. The motor is mounted in a vertical orientation with respect to the floor on which the vacuum cleaner 10 is supported. Motor 24 is operated by a source of AC power. Motor 24 is connected to the source of power via AC power plug 26. Each of the half housing elements includes a plurality of air vents 28 for providing cooling air to and from the motor.

Motor 24 drives a shaft 30 connected thereto. Fan 32 is mounted on shaft 30 for rotation therewith. Shaft 30 also is connected to belt 34 which, as described previously, drives brush 18. Internal walls of half housing elements 12, 14 define, in part, working air channel 36. Channel 36 commences at nozzle 20 and terminates at an outlet chute 38. Outlet chute 38 extends from backwall 58 of housing 11. Outlet chute 38 directs the working air drawn into the vacuum cleaner into a dirty air bag assembly 40. The upper surface of outlet chute 38 includes a generally arcuate or curved wall 54 for directing the working air towards the rear of the bag. Curved wall 54 deflects any debris entrained within the working air away from the user and enables the velocity of the entrained debris to decrease before the debris hits any surface of the bag. Curved wall 54 facilitates the filling of the bag. It is particularly important to note that outlet chute 38 is positioned at the top of the bag assembly. It has been determined that more dirt can be captured within a given size bag when the chute is positioned at the top of the bag assembly rather than at the bottom thereof.

Bag assembly 40 includes a dirt collector bag 41 (shown in phantom) which is attached to a collar 42. Bag assembly 40 is removably secured to housing 11. Collar 42 includes a pair of depending spaced bosses 43 which provide support for a pivot pin 44. A combined handle and latch member 46 is pivotally attached to pivot pin 44. Collar 42 has an inwardly extending finger 62 formed on its top surface. Finger 62 mates with an indented section 64 formed in the top of housing 11 so that the collar and attached bag assembly 40 are properly aligned on the housing.

Handle and latch member 46 includes a slightly canted upwardly extending rib 50 provided at its forward end. Rib 50 mates with a detent 48 formed on member 22 to latch the collar and bag assembly onto housing 11. Lower wall 22 further includes a pair of guide ribs 52 for guiding rib 50 on handle and latch member 46 into proper position with respect to detent 48. A more detailed explanation of the latch and sealing arrangement for bag assembly 40 is described in copending application, Ser. No. 637,413, filed concurrently herewith in the names of Charles A. Reed, Jr., Charles Z. Krasznai, Richard B. Kosten and Robert Osit and assigned to the same assignee as the assignee hereof.

In operation, air is drawn through nozzle 20 and it passes in a generally straight line through air channel 36 and thence into fan inlet 60. Fan 32 discharges the air through outlet chute 38 with the curved upper wall thereof directing the air towards the rear of collector bag 41. The air flow path from nozzle 20 to outlet chute 38 is in generally a straight path. There are no 90° bends at the fan outlet and thus air flow losses are maintained at a minimum. By maintaining the air flow losses at a minimum, the effective cleaning efficiency of cleaner 10 is maintained at a relatively high level. The relatively high cleaning efficiency of the cleaner is attained primarily because the motor 24 and shaft 30 are mounted in a relatively vertical orientation with respect to bottom wall member 22. Shaft 30 is positioned generally normal to the direction of the working air flow through channel 36. In actuality, the motor and shaft are mounted at a 5° to 12° angle relative to a vertical axis, with motor 24 being tilted towards the front of cleaner 10.

In the hand-held vacuum cleaner illustrated in U.S. Pat. No. 4,891,861, the motor is mounted in a horizontal plane. The working air flows through the nozzle into the vacuum cleaner housing and then is drawn vertically upward to pass into the fan inlet. The air is then discharged radially outwardly and must make a 90° bend to pass into the working air channel. The center of the air inlet for the fan is approximately 3 inches above the nozzle. The working air channel terminates in an outlet communicating with the lower open end of a bag assembly. The aforedescribed air flow path results in significant flow losses reducing the overall cleaning efficiency of the cleaner thus described. The position of the outlet at the lower open end of the bag assembly results in the working air channel becoming clogged with dirt further degrading the performance of the cleaner.

In the vacuum cleaner embodying the present invention, the center of the fan is only ¾ of an inch above the nozzle as a result of the vertical mounting of the motor and fan. Further, the air flow from the fan follows a generally straight line as the air passes into the collector bag 41. Operation of brush 18 assists in propelling the debris towards fan inlet 60. The debris tends to follow a tangential flow path when thrown from the brush. The tangential flow path is co-axial with working air channel 36. When the motor is mounted in a horizontal plane, the brush does not provide the same assistance in throwing the debris towards the fan inlet as it does when the motor is mounted in a vertical plane.

The position of the outlet at the open upper end of bag 41 minimizes clogging of the working air channel. Thus, the efficiency of the cleaner embodying the present invention is greater than the efficiency of vacuum cleaners of the type represented in the previously described United States patent.

A further advantage of mounting the motor in a vertical plane as compared to mounting the motor in a horizontal plane is manifested when it is necessary to replace belt 34. To replace the belt, wall 22 is easily removed to provide access to the belt shaft 30 and spindle 19. With cleaners mounted in a horizontal plane, a front panel on the cleaner is removed providing only limited access to the belt and its associated mechanisms. In some instances, manufacturers have provided the users with special tools to replace the belt.

Vacuum cleaner 10 may include an attachment connector for attaching additional elements such as a hose to the cleaner. A more detailed explanation of the attachment connector is described in copending application, Ser. No. 637,414, filed concurrently herewith in the names of Richard B. Kosten, Charles Z. Krasznai and Robert Osit and assigned to the same assignee as the assignee hereof.

While a preferred embodiment of the present invention has been described and illustrated, the invention should not be limited thereto, but may be otherwise embodied within the scope of the following claims.

What is claimed is:

1. A hand-held vacuum cleaner including a housing comprising mating first and second half housing elements, said housing having a handle and a nozzle, a motor mounted within the housing for driving a shaft, said shaft extending within said housing in a substantially vertically upward direction when the cleaner is in a position to clean a horizontal surface, a fan mounted on said shaft for rotation therewith, a selectively separable bag assembly mounted on said housing in spaced relation relative to said nozzle along the horizontal axis of the cleaner, a rotating brush mounted within the nozzle, drive means connecting said shaft to said brush for rotationally driving said brush, means defining a working air channel within said housing communicating said nozzle with said bas assembly, a first portion of said working air channel directing said working air and entrained debris substantially parallel to the flow path of debris thrown from said rotating brush, and into the inlet of said fan, the outlet of said fan directing the air and entrained debris into a second portion of said working air channel, said second portion of said working air channel having an initial radially extending section communicating directly with said fan outlet and a second section extending upwardly within said housing and terminating at the inlet into said bag assembly, said inlet into said bag assembly being positioned adjacent the top wall of the bag of said assembly.

2. A hand-held vacuum cleaner in accordance with claim 1 wherein the second section of said second portion of said air channel includes a substantially arcuate wall for directing the working air and entrained debris towards the rear of said bag assembly.

3. A hand-held vacuum cleaner in accordance with claim 2 wherein the housing includes a removable bottom wall member and said drive means comprises an endless belt, removal of said bottom wall member from said housing providing access for enabling the user of the cleaner to replace said belt.

4. A hand-held vacuum cleaner in accordance with claim 1 wherein the housing includes a removable bottom wall member and said drive means comprises an endless belt, removal of said bottom wall member from said housing providing access for enabling the user of the cleaner to replace said belt.

* * * * *